US012247408B2

(12) United States Patent
Deng et al.

(10) Patent No.: US 12,247,408 B2
(45) Date of Patent: Mar. 11, 2025

(54) OPERATION VEHICLE

(71) Applicant: SANY AUTOMOBILE MANUFACTURING CO., LTD., Hunan (CN)

(72) Inventors: Biao Deng, Hunan (CN); DaPeng Xu, Hunan (CN); Jiangbo Li, Hunan (CN)

(73) Assignee: Sany Automobile Manufacturing Co., Ltd., Hunan (CN)

( * ) Notice: Subject to any disclaimer, the term of this patent is extended or adjusted under 35 U.S.C. 154(b) by 71 days.

(21) Appl. No.: 18/037,814

(22) PCT Filed: Jun. 29, 2021

(86) PCT No.: PCT/CN2021/102976

§ 371 (c)(1),
(2) Date: May 19, 2023

(87) PCT Pub. No.: WO2022/105234

PCT Pub. Date: May 27, 2022

(65) Prior Publication Data

US 2024/0003149 A1 Jan. 4, 2024

(30) Foreign Application Priority Data

Nov. 20, 2020 (CN) ..... 202011314762.0

(51) Int. Cl.
*E04G 21/04* (2006.01)

(52) U.S. Cl.
CPC ..... *E04G 21/0436* (2013.01); *E04G 21/0445* (2013.01); *Y10T 137/6881* (2015.04); *Y10T 137/8807* (2015.04)

(58) Field of Classification Search
CPC ..... Y10T 137/8807; Y10T 137/6881; E04G 21/0436; E04G 21/0445
See application file for complete search history.

(56) References Cited

U.S. PATENT DOCUMENTS 4,418,713 A * 12/1983 Schlecht ..... E04G 21/0436 280/766.1
4,828,033 A * 5/1989 Frison ..... B67D 7/002 166/292

(Continued)

FOREIGN PATENT DOCUMENTS

CN 101397850 A 4/2009
CN 201818056 U 5/2011

(Continued)

OTHER PUBLICATIONS

International Search Report mailed Sep. 8, 2021 in International Patent Application: PCT/CN2021/102976.

(Continued)

*Primary Examiner* — Craig M Schneider
*Assistant Examiner* — Frederick D Soski
(74) *Attorney, Agent, or Firm* — Miles & Stockbridge PC; Ajay A. Jagtiani

(57) ABSTRACT

An operation vehicle, comprising a vehicle body and a cab provided at a front end of the vehicle body, and further comprising a boom device. The boom device comprises at least seven booms hinged end to end in sequence. When the boom device is in a folded state, a fifth boom and a sixth boom are located on the same straight line, a seventh boom is located below the sixth boom, and end portions of at least two booms in the seven booms are located above the cab. The technical solutions of the present application overcome the defect in the prior art that the flexibility of boom construction of the operation vehicle is low.

1 Claim, 9 Drawing Sheets

(56) References Cited

U.S. PATENT DOCUMENTS 5,535,780 A * 7/1996 Schlecht ..... E04G 21/04 141/387
5,640,996 A * 6/1997 Schlecht ..... B66C 13/40 91/361
6,390,504 B1 * 5/2002 Fetzer ..... B60S 9/02 280/763.1
6,779,688 B1 * 8/2004 Mayer ..... E04G 21/04 141/86
6,834,911 B2 * 12/2004 Schillinger ..... E04G 21/0436 296/184.1
6,983,763 B2 * 1/2006 Benckert ..... E04G 21/0436 141/387
7,204,269 B2 * 4/2007 Alwes ..... E04G 21/04 141/387
7,478,834 B2 * 1/2009 Schlecht ..... E04G 21/0436 280/763.1
7,654,800 B2 * 2/2010 Leibbrand ..... E04G 21/04 417/900
7,909,059 B2 * 3/2011 Wehner ..... B66C 23/78 141/387
8,282,130 B2 * 10/2012 Fuegel ..... E04G 21/0436 280/765.1
9,376,827 B2 * 6/2016 Hasel ..... E04G 21/0445
9,377,032 B2 * 6/2016 Fuegel ..... E04G 21/04
9,394,707 B2 * 7/2016 Yi ..... E04G 21/0436
9,476,211 B2 * 10/2016 Westermann ..... F16M 13/022
9,856,661 B2 * 1/2018 Westermann ..... E04G 21/0463
2007/0277881 A1 * 12/2007 Fugel ..... E04G 21/04 137/351
2014/0175254 A1 * 6/2014 Yi ..... E04G 21/0445 248/558
2014/0325976 A1 * 11/2014 Schabelreiter ..... F15B 15/061 248/558
2015/0008702 A1 * 1/2015 Wu ..... E04G 21/0445 248/558
2015/0056084 A1 * 2/2015 Fuegel ..... E04G 21/0445 417/234
2015/0136266 A1 * 5/2015 David ..... E04G 21/0436 138/106
2015/0204089 A1 * 7/2015 Ruppel ..... E04G 21/0436 248/558
2016/0025128 A1 * 1/2016 Fügel ..... F16C 11/04 16/374
2016/0032602 A1 * 2/2016 Fügel ..... B60S 9/02 248/49
2016/0185359 A1 * 6/2016 Mayer ..... B60W 50/14 701/2
2016/0326755 A1 * 11/2016 Westermann ..... E04G 21/0445
2024/0310842 A1 * 9/2024 Bukschat ..... G01S 5/0027

FOREIGN PATENT DOCUMENTS

CN 102182319 A 9/2011
CN 102383603 A 3/2012
CN 102425308 A 4/2012
CN 102518305 A 6/2012
CN 102518309 A 6/2012
CN 102561703 A 7/2012
CN 203022349 U 6/2013
CN 203050124 U 7/2013
CN 204001764 U 12/2014
CN 204098503 U 1/2015
DE 3445130 A1 2/1986
DE 3446290 A1 6/1986
DE 10145632 A1 4/2003
EP 0663978 B1 2/1996
EP 1847667 A2 10/2007
EP 2746491 A1 6/2014
EP 4299856 A1 1/2024
IT MI20050434 A1 9/2006
WO 2004113647 A1 12/2004
WO 2004113648 A1 12/2004
WO 2006097827 A2 9/2006

OTHER PUBLICATIONS

Written Opinion mailed Sep. 8, 2021 in International Patent Application: PCT/CN2021/102976.
Chinese First Office Action of corresponding Chinese Patent Application No. 202011314762.0 mailed Sep. 19, 2022.
Extended European Search Report issued Mar. 1, 2024 in corresponding EP Application No. 21 893 386.9.

* cited by examiner

OPERATION VEHICLE

The present application claims the priority of Chinese Patent Application No. 202011314762.0, filed with the Chinese Patent Office on Nov. 20, 2020 and entitled "Operation Vehicle", which is hereby incorporated by reference in its entirety.

TECHNICAL FIELD

The present application relates to the technical field of pumping equipment, in particular to an operation vehicle.

BACKGROUND

A concrete pump vehicle is provided with a rotary table and a boom device arranged on the rotary table. The boom device includes a plurality of booms, and when being driven by a driving device, the plurality of booms can be expanded, converged, rotated and folded. The boom device is fixed with a conveying pipe, and the conveying pipe moves along with the boom device, to convey concrete to designated positions. When a concrete pump vehicle is in a non-working state, a plurality of booms are folded to possibly reducing space occupied by the concrete pump vehicle.

When the boom device is in a folded state, since the boom device is limited in a height direction, a space for arrangement in a vertical direction is small. Therefore, making full use of a space in a vertical direction to compactly fold the boom device is crucial for increasing a total length of the boom device and improving flexibility of material distribution of the boom device. At present, folding manners of a boom device of a concrete pump vehicle mainly include an R-type manner, a Z-type manner and an RZ-type manner. The R-type folding manner refers to a folding manner in which a plurality of booms are folded towards one direction such as a clockwise direction through a manner of winding or intervolving or expanded towards an opposite direction such as an anticlockwise direction. The Z-type folding manner refers to a folding manner in which a plurality of booms are folded or expanded in directions which are opposite in sequence. An RZ type is a combination of an R type and a Z type.

A tail end structure of a pump vehicle boom in the prior art is mainly in two forms, in one form, as shown in FIG. 1, two booms at tail ends are two whole booms, in another form, as shown in FIG. 2, the last boom is disconnected by two sections, an expanded angle is about 90°-180°, and the penultimate boom is a whole boom. For a tail end structure of the above boom, when the first structural form is adopted, two booms at tail ends are both whole booms. For long-boom pump trucks (pump trucks with boom lengths being greater than 50 meters), two booms are tail ends are too long, thereby greatly reducing construction flexibility; when the second structural form is adopted, although the last boom is disconnected by two sections, since an expanded angle is only and the penultimate boom is too long, the construction flexibility is also greatly limited.

SUMMARY OF THE INVENTION

The present application aims at solving at least one of the technical problems existing in the prior art or in related techniques.

To this end, the present application aims at overcoming the defect in the prior art that the flexibility of boom construction of the pump vehicle is low, so as to provide an operation vehicle.

To achieve the above object, technical solutions of the present application provides an operation vehicle, including a vehicle body and a cab provided at a front end of the vehicle body, and further including a boom device provided on the vehicle body, the boom device includes at least seven booms hinged end to end in sequence, wherein when the boom device is in a folded state, a fifth boom and a sixth boom are both located on the same straight line, a seventh boom is located below the sixth boom, and end portions of at least two booms in the seven booms are located above the cab.

Optionally, the operation vehicle further includes a rotary table arranged on the vehicle body, the rotary table is arranged on a front part or a middle part of the vehicle body, a head end of a first boom is connected with the rotary table, and a tail end of the fourth boom and a head end of the fifth boom are located above the cab.

Optionally, the rotary table is arranged at a front part of the vehicle body, and a hinged point between the rotary table and the first boom is located above the cab.

Optionally, when the boom device is in the folded state, the second boom is located below the first boom, a head end of a third boom is located above the second boom, the fourth boom is located above the third boom, and the fifth boom, the sixth boom and the seventh boom are located above the fourth boom, wherein the first boom, the second boom and the head end of the third boom are folded in a first vertical plane, a tail end of the third boom, the fourth boom and the fifth boom are folded in a second vertical plane, the third boom is a corner-turning boom, and the third boom transitions from within the first vertical plane to within the second vertical plane.

Optionally, when the boom device is in the folded state, the second boom is located below the first boom, the head end of the third boom is located between the first boom and the second boom, a head end of the fourth boom is located below the third boom, the tail end of the fourth boom is located above the third boom, and the fifth boom, the sixth boom and the seventh boom are located above the fourth boom, wherein the first boom, the second boom and the head end of the third boom are folded in the first vertical plane, the tail end of the third boom, the fourth boom and the fifth boom are folded in a second vertical plane, the third boom is a corner-turning boom, and the third boom transitions from within the first vertical plane to within the second vertical plane.

Optionally, the rotary table is arranged on a middle part of the vehicle body, the first boom, the second boom and the third boom are folded in an R-type manner, and the second boom, the third boom and the fourth boom are folded in an R-type manner.

Optionally, when the boom device is in the folded state, the second boom is located above the first boom, the head end of the third boom is located between the second boom and the first boom, the fourth boom is located above the third boom, and the fifth boom, the sixth boom and the seventh boom are located above the fourth boom, wherein the first boom, the second boom and the head end of the third boom are folded in the first vertical plane, the tail end of the third boom, the fourth boom and the fifth boom are folded in a second vertical plane, the third boom is a corner-turning boom, and the third boom transitions from within the first vertical plane to within the second vertical plane.

Optionally, when the boom device is in the folded state, the second boom is located above the first boom, the third boom includes a front half section, a rear half section and a middle corner-turning portion for avoiding the rotary table, the front half section of the third boom is located below the second boom, the fourth boom is located above the rear half section of the third boom, the first boom, the second boom and the front half section of the third boom are folded in the first vertical plane, the rear half section of the third boom and the fourth boom are folded in a second vertical plane, the third boom is a corner-turning boom, and the middle corner-turning portion of the third boom transitions from within the first vertical plane to within the second vertical plane.

Optionally, the operation vehicle further includes a vehicle body and a rotary table arranged on the vehicle body, the rotary table is arranged on a rear part of the vehicle body, the head end of the first boom is connected with the rotary table, and end portions of the third boom, the fourth boom, the sixth boom and the seventh boom are all located above the cab.

Optionally, the operation vehicle is a pump vehicle.

Technical solutions of the present application have the following advantages:

When the technical solutions of the present application are adopted, the penultimate boom is divided into a fifth boom and a sixth boom, such that the fifth boom and the sixth boom are not too long, and the expanded angle of the seventh boom is large. Meanwhile, end portions of at least two booms are located above the cab, to fully utilize a space above the cab, and the whole boom device can be made longer, thereby greatly improving material distribution range and construction flexibility. Therefore, the technical solutions of the present application overcome the defect in the prior art that the flexibility of boom construction of the pump vehicle is low.

Additional aspects and advantages of the present application will become apparent in the description below, or will be learned through practice of the present application.

BRIEF DESCRIPTION OF THE DRAWINGS

The above and/or additional aspects and advantages of the present application will become apparent and easy to understand from the description of embodiments in combination with the accompanying drawings, wherein.

Figure 1:
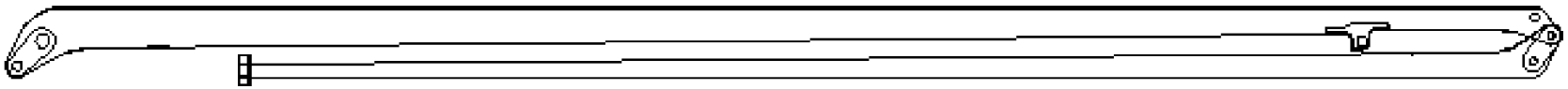
Figure 1 Prior Art
FIG. 1 shows a structural schematic diagram of a first type of tail end of a boom in the prior art.
Figure 2:
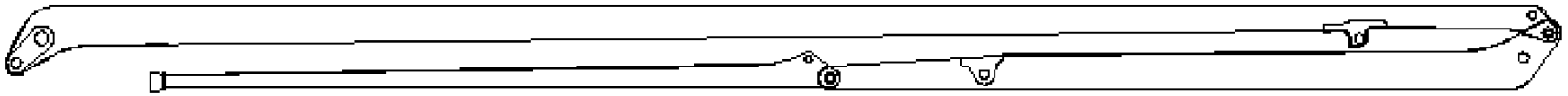
Figure 2 Prior Art
FIG. 2 shows a structural schematic diagram of a second type of tail end of a boom in the prior art.

Wherein reference numerals and component names in FIGS. 1 to 10 are as follows:

1, first boom; 2, second boom; 3, third boom; 4, fourth boom; 5, fifth boom; 6, sixth boom; 7, seventh boom; 100, boom device; 200, rotary table; 300, cab.

DETAILED DESCRIPTION

Technical solutions of the present application will be described clearly and completely below in combination with accompanying drawings. Apparently, the described embodiments are merely part, but not all, of the embodiments of the present application. All the other embodiments obtained by those skilled in the art without any creative effort based on the embodiments in the present application shall all fall within the protection scope of the present application.

In the description of the present application, it should be noted that, the orientation or positional relationship indicated by such terms as "center", "up", "down", "left", "right", "vertical", "horizontal", "inner" and "outer" is the orientation or positional relationship based on the accompanying drawings. Such terms are merely for the convenience of description of the present application and simplified description, rather than indicating or implying that the device or element referred to must be located in a certain orientation or must be constructed or operated in a certain orientation, therefore, the terms cannot be understood as a limitation to the present application. In addition, such terms as "first", "second" and "third" are merely for a descriptive purpose, and cannot be understood as indicating or implying relative importance.

In the description of the present application, it should be noted that, unless otherwise stipulated and defined definitely, such terms as "installed", "connected" and "in connection" should be understood in their broad sense, e.g., the connection can be a fixed connection, a detachable connection or an integral connection; can be mechanical connection or electrical connection; and can be direct connection, or can be indirect connection through an intermediate, or can be communication inside two elements. For those skilled in the art, specific meanings of the above terms in the present application can be understood according to specific conditions.

In addition, the technical features involved in different embodiments of the present application described below can be combined with each other as long as they do not conflict with each other.

Embodiment 1

Figure 3:
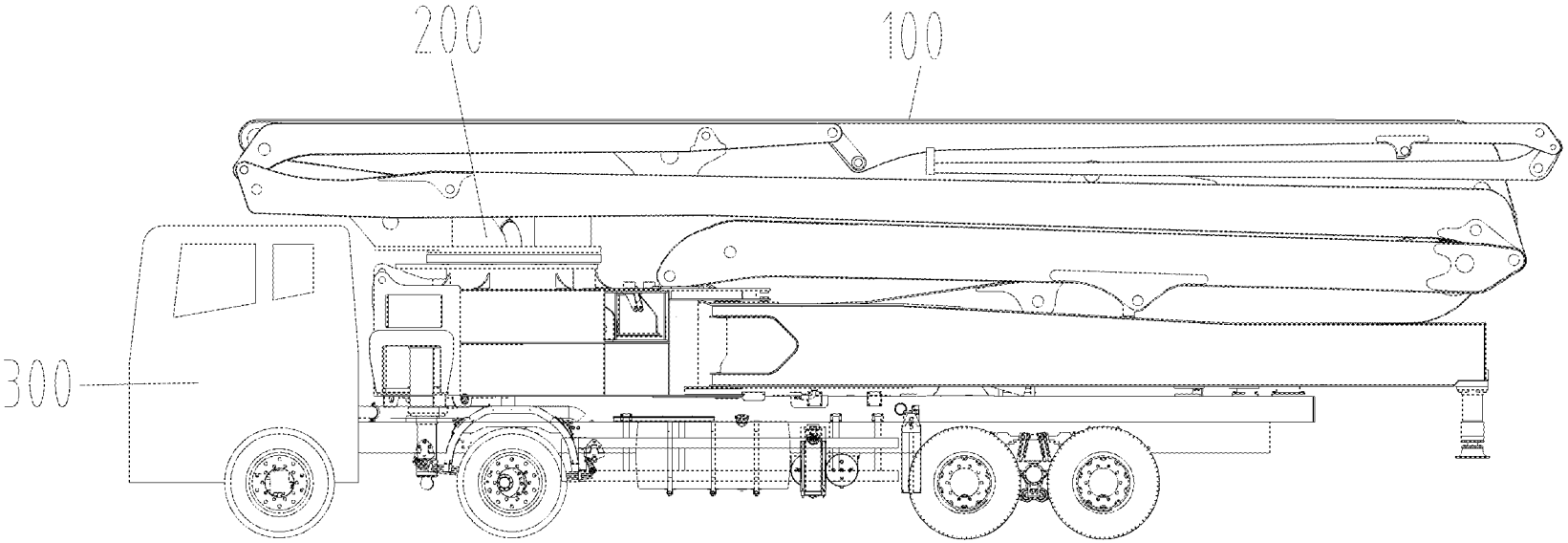
FIG. 3 shows a structural schematic diagram of Embodiment 1 of a pump vehicle of the present application.
Figure 4:
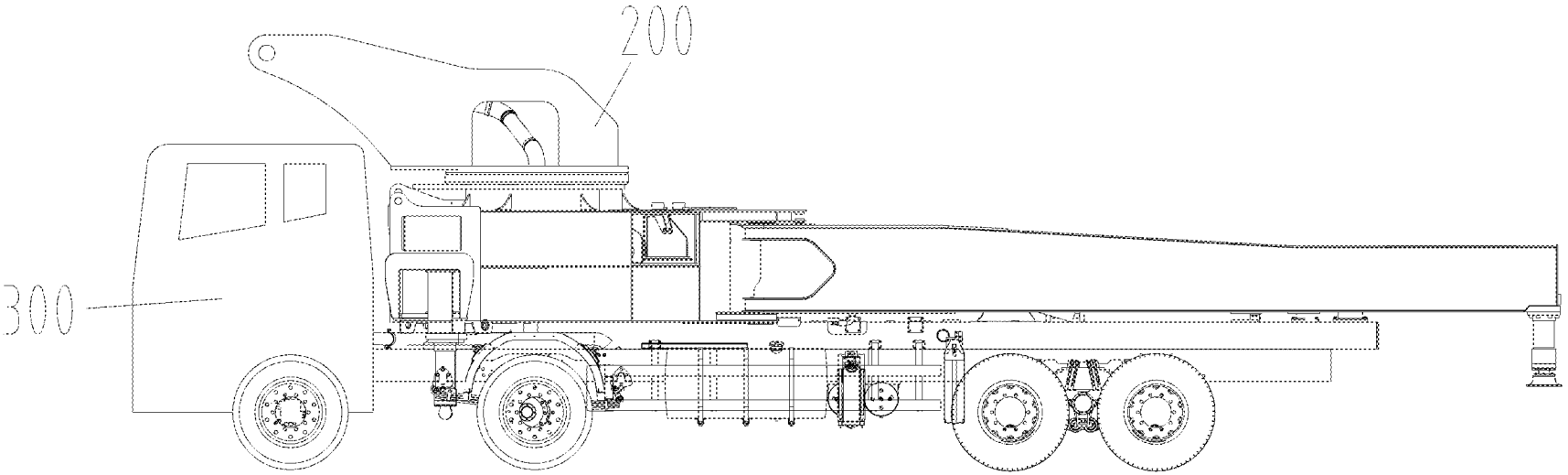
FIG. 4 shows a structural schematic diagram of an operation vehicle in FIG. 3 when the operation vehicle is not installed with a boom device.
Figure 5:
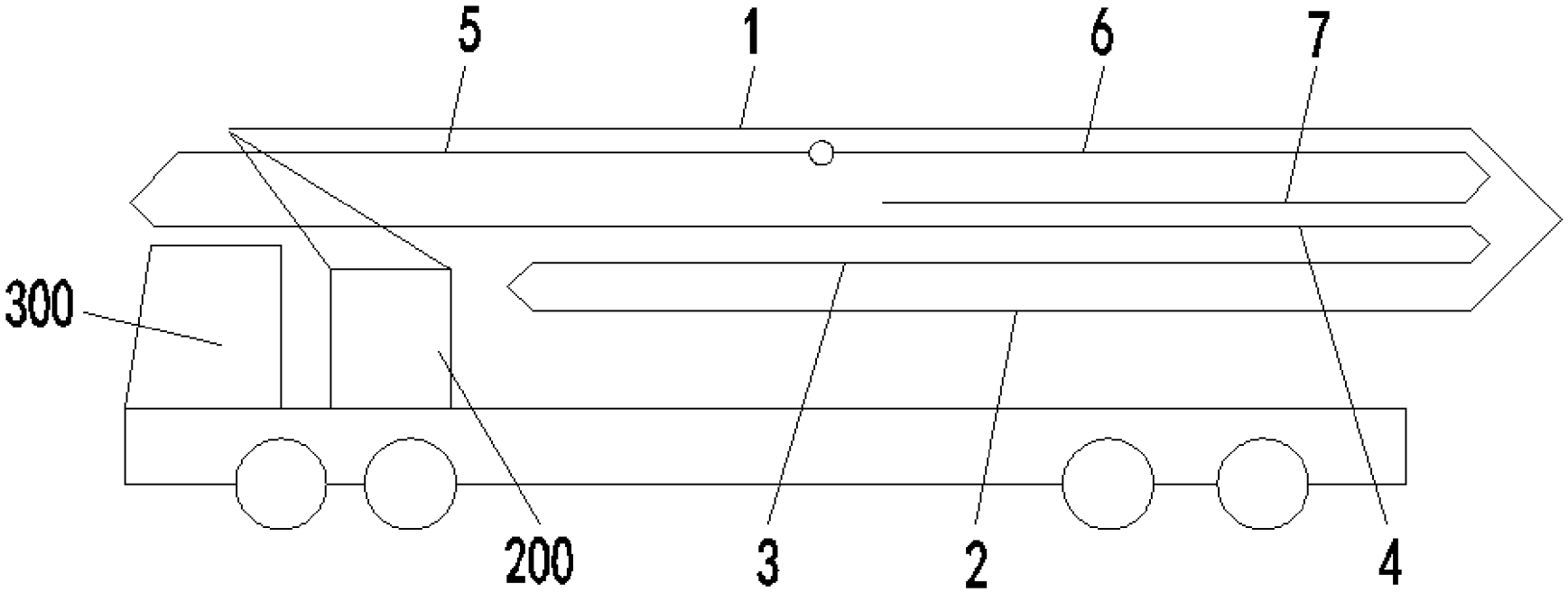
FIG. 5 shows a structural schematic diagram of a boom device of an operation vehicle in FIG. 3.

As shown in FIG. 3 to FIG. 5, an operation vehicle in Embodiment 1 includes a vehicle body and a cab 300 provided at a front end of the vehicle body, and meanwhile the operation vehicle further includes a boom device 100, the boom device 100 can be provided on the vehicle body via such devices as a rotary table 200, specific setting positions of the boom device 100 can be set according to requirements, for example, the boom device 100 can be arranged at a front part, a middle part or a rear part behind the cab, the boom device 100 includes at least seven booms hinged end to end in sequence, wherein when the boom device 100 is in a folded state, a fifth boom 5 and a sixth boom 6 are located on the same straight line, a seventh boom 7 is located below the sixth boom 6, and end portions of at least two booms in the seven booms are located above the cab 300.

When the technical solutions of Embodiment 1 are adopted, the penultimate boom is divided into a fifth boom 5 and a sixth boom 6, the fifth boom 5 and the sixth boom 6 are not too long, and the expanded angle of the seventh boom 7 is large. Meanwhile, end portions of at least two booms are located above the cab 300, to fully utilize the space above the cab 300, and the whole boom device can be made longer, thereby greatly improving material distribution range and construction flexibility. Therefore, technical solutions of the present embodiment overcome the defect in the prior art that the flexibility of boom construction of the pump vehicle is low.

It should be noted that, the operation vehicle in the present embodiment is a pump vehicle, however, the operation vehicle can also be other vehicle devices, such as a firefighter.

Preferably, the expanded angle of the seventh boom 7 in Embodiment 1 relative to the sixth boom 6 is in a range of 0 degrees to 210 degrees. Specifically speaking, since the sixth boom 6 and the seventh boom 7 are not very long, expanded angles of the sixth boom 6 and the seventh boom 7 can be designed to be greater, therefore, the construction is more flexible.

As shown in FIG. 3 and FIG. 4, the pump vehicle in Embodiment 1 further includes a vehicle body and a rotary table 200 arranged on the vehicle body, the rotary table 200 is arranged on a front part of the vehicle body, a head end of the first boom 1 is connected with the rotary table 200, and a tail end of the fourth boom 4 and a head end of the fifth boom 5 are located above the cab 300. Specifically speaking, the pump vehicle in Embodiment 1 is a pump vehicle arranged in front of the rotary table, end portions of the fourth boom 4 and the fifth boom 5 extend above the cab 300, such that the fourth boom 4 and the fifth boom 5 can be designed to be as long as possible, and construction flexibility is improved.

As shown in FIG. 4, in technical solutions of Embodiment 1, the rotary table 200 is arranged at a front part of the vehicle body, and a hinged point between the rotary table 200 and the first boom 1 is located above the cab 300. Specifically speaking, through the above structure, an end portion of the first boom 1 extends above the cab 300, such that the first boom 1 can be as long as possible, and construction flexibility is improved.

As shown in FIG. 5, in technical solutions in Embodiment 1, the first boom 1, the second boom 2, the third boom 3 and the fourth boom 4 are folded in an RZ-type manner. Specifically speaking, the first boom 1, the second boom 2 and the third boom 3 are first folded in an R-type manner, and then the second boom 2, the third boom 3 and the fourth boom 4 are folded in a Z-type manner, thereby forming RZ-type folding. Specific folding manners of the first boom 1, the second boom 2, the third boom 3 and the fourth boom 4 are as follows: the first boom 1 extends along a horizontal direction, and the second boom 2 is folded downwards clockwise relative to the first boom 1. The third boom 3 is folded upwards clockwise relative to the second boom 2, moreover, the third boom 3 is located above the second boom 2, and the first boom 1, the second boom 2 and the third boom 3 are folded clockwise in an R-type manner through winding. The fourth boom 4 is folded upwards anticlockwise relative to the third boom 3, moreover, the fourth boom 4 is located above the third boom 3, and further, the tail end of the fourth boom 4 extends above the cab 300. Since the folding directions of the fourth boom 4 and the third boom 3 are opposite to the folding directions of the third boom 3 and the second boom 2, therefore, the fourth boom 4, the third boom 3 and the second boom 2 are all folded in a Z-type manner. The tail end of the fourth boom 4 is connected with the fifth boom 5, the sixth boom 6 and the seventh boom 7, meanwhile, since the tail end of the fourth boom 4 is located above the cab 300, therefore, the head end of the fifth boom 5 is also located above the cab 300. The fifth boom 5, the sixth boom 6 and the seventh boom 7 are arranged between the first boom 1 and the fourth boom 4.

Further, the first boom 1, the second boom 2 and the head end of the third boom 3 are folded in the first vertical plane, the tail end of the third boom 3, the fourth boom 4 and the fifth boom 5 are folded in a second vertical plane, the third boom 3 is a corner-turning boom, and the third boom 3 transitions from within the first vertical plane to within the second vertical plane.

In technical solutions of Embodiment 1, the fourth boom 4 is a corner-turning boom, and bends downwards at least at an end close to the front end of the vehicle body. Specifically speaking, the fourth boom 4 is designed to be a corner-turning boom (bending downwards) in a height direction, space in a height direction is fully utilized, a cross section of a small-head box body of the fourth boom 4 and a cross section of a large-head box body of the fifth boom 5 can be made higher, and rigidity and resistance to torsion of two booms are dramatically improved.

Embodiment 2

Figure 6:
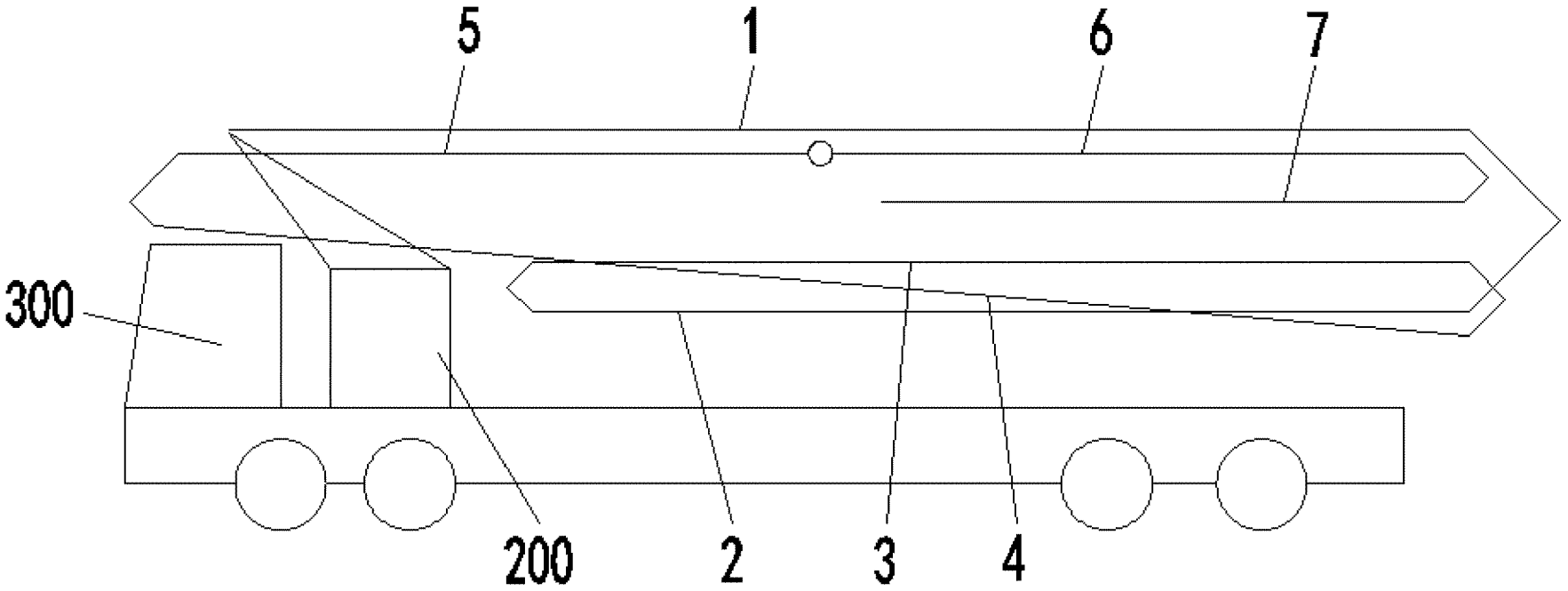
FIG. 6 shows a structural schematic diagram of a boom device of Embodiment 2 of an operation vehicle of the present application.

As shown in FIG. 6, the pump vehicle in Embodiment 2 differs from the pump vehicle in Embodiment 1 as follows: the folding manners of the first boom 1, the second boom 2, the third boom 3 and the fourth boom 4 are different. Specifically speaking, the first boom 1, the second boom 2 and the third boom 3 are folded in an R-type manner, and the second boom 2, the third boom 3 and the fourth boom 4 are folded in an R-type manner.

Further, positional relationships and folding manners of the first boom 1, the second boom 2, the third boom 3 and the fourth boom 4 in Embodiment 2 are specifically as follows: the first boom 1 extends along a horizontal direction, and the second boom 2 is folded downwards clockwise relative to the first boom 1. The third boom 3 is folded upwards clockwise relative to the second boom 2, moreover, the third boom 3 is arranged above the second boom 2. The fourth boom 4 is folded downwards clockwise relative to the third boom 3, and particularly, the head end of the fourth boom 4 is located below the second boom 2, and the tail end of the fourth boom 4 is located above the third boom 3. The above structure enables that the fourth boom 4 extends upwards in an inclined manner and respectively penetrates through the second boom 2 and the third boom 3, moreover, the tail end of the fourth boom 4 extends above the cab 300. The tail end of the fourth boom 4 is connected with the fifth boom 5, the sixth boom 6 and the seventh boom 7, meanwhile, since the tail end of the fourth boom 4 is located above the cab 300, therefore, the head end of the fifth boom 5 is also located above the cab 300. The fifth boom 5, the sixth boom 6 and the seventh boom 7 are arranged between the first boom 1 and the fourth boom 4.

Further, the first boom 1, the second boom 2 and the head end of the third boom 3 are folded in the first vertical plane, the tail end of the third boom 3, the fourth boom 4 and the fifth boom 5 are folded in a second vertical plane, the third boom 3 is a corner-turning boom, and the third boom 3 transitions from within the first vertical plane to within the second vertical plane.

Except for different folding manners of each of the above booms, the pump vehicle structure in Embodiment 2 is the same as the pump vehicle structure in Embodiment 1, and will not be repeated redundantly herein.

Embodiment 3

Figure 7:
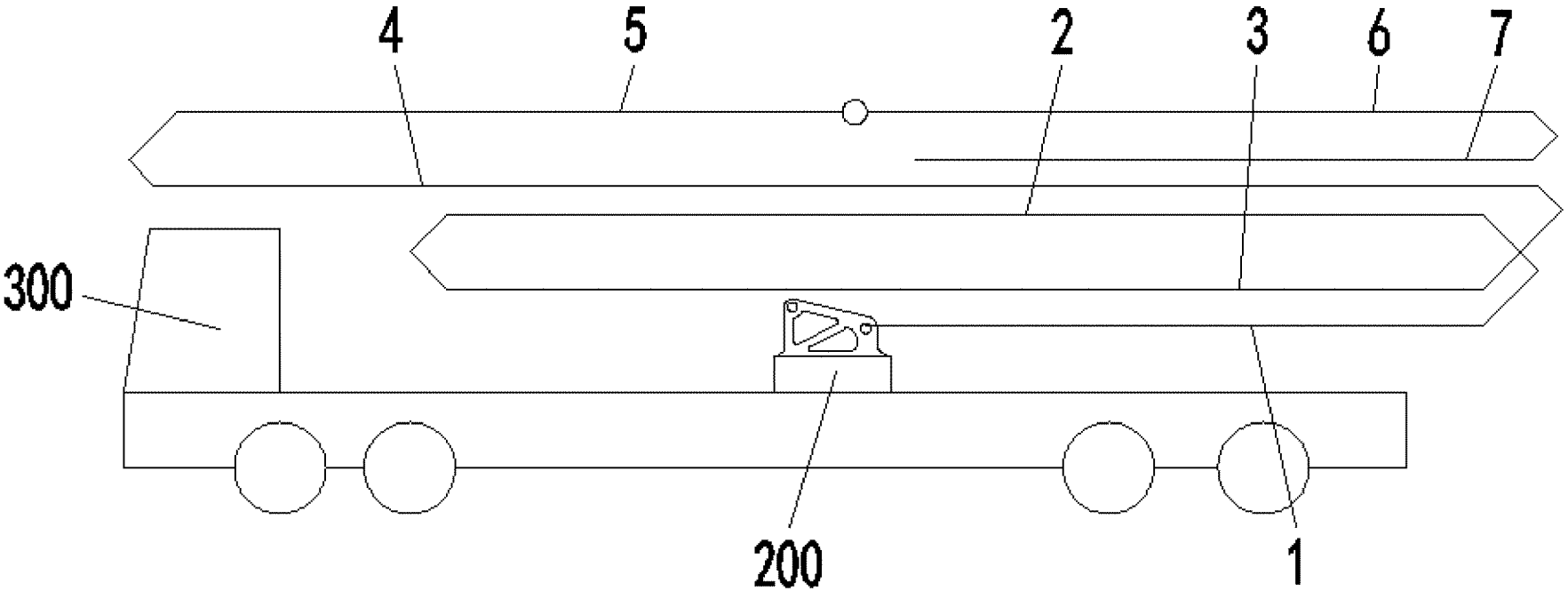
FIG. 7 shows a structural schematic diagram of a boom device of Embodiment 3 of an operation vehicle of the present application.

As shown in FIG. 7, the pump vehicle in Embodiment 3 differs from the pump vehicle in Embodiment 1 and Embodiment 2 as follows: the rotary table 200 is arranged on a middle part of the vehicle body, therefore, the pump vehicle in Embodiment 3 is a pump vehicle arranged in the rotary table 200. Moreover, the first boom 1, the second boom 2 and the third boom 3 are folded in an R-type manner, and the second boom 2, the third boom 3 and the fourth boom 4 are folded in an R-type manner.

Specifically speaking, positional relationships and folding manners of the first boom 1, the second boom 2, the third boom 3 and the fourth boom 4 in Embodiment 3 are specifically as follows: the first boom 1 extends along a horizontal direction, and the second boom 2 is folded upwards anticlockwise relative to the first boom 1. The third boom 3 is folded downwards anticlockwise relative to the second boom 2, moreover, the third boom 3 is arranged below the second boom 2. The fourth boom 4 is folded upwards anticlockwise relative to the third boom 3, moreover, the fourth boom 4 is located above the third boom 3, and further, the tail end of the fourth boom 4 extends to an upper end of the cab 300. The tail end of the fourth boom 4 is connected with the fifth boom 5, the sixth boom 6 and the seventh boom 7, meanwhile, since the tail end of the fourth boom 4 is located above the cab 300, therefore, the head end of the fifth boom 5 is also located above the cab 300. The fifth boom 5, the sixth boom 6 and the seventh boom 7 are all arranged above the fourth boom 4.

Further, the first boom 1, the second boom 2 and the head end of the third boom 3 are folded in the first vertical plane, the tail end of the third boom 3, the fourth boom 4 and the fifth boom 5 are folded in a second vertical plane, the third boom 3 is a corner-turning boom, and the third boom 3 transitions from within the first vertical plane to within the second vertical plane, wherein the third boom 3 turns around at its head end or tail end.

Figure 9:
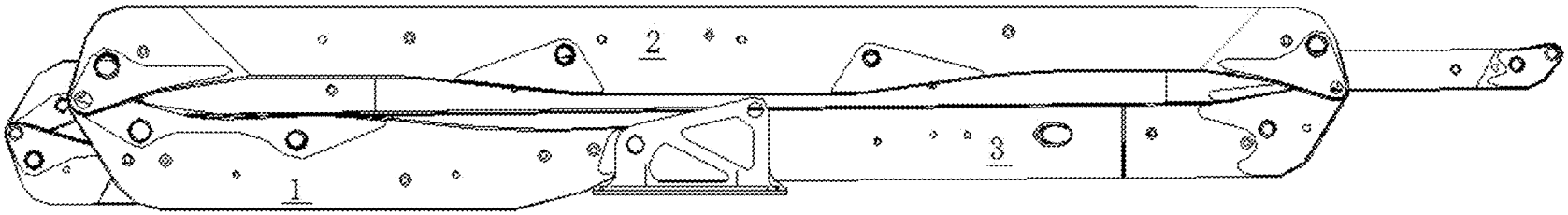
FIG. 9 shows a rear view with front four booms of a boom device being provided in an alternative embodiment of Embodiment 3 of an operation vehicle of the present application.
Figure 10:
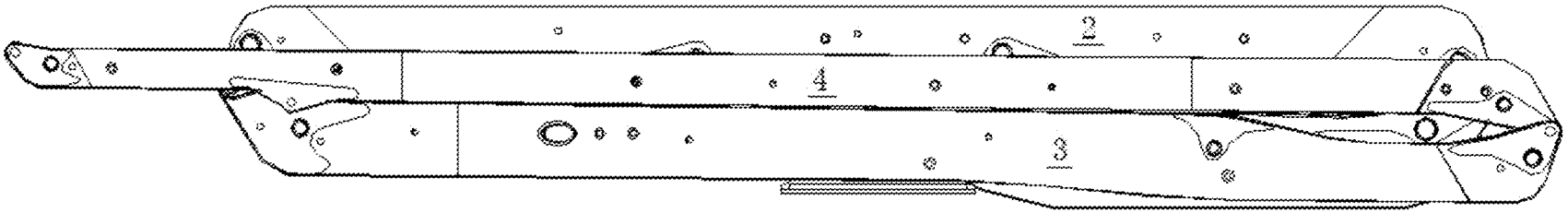
FIG. 10 shows a front view with front four booms of a boom device being provided in an alternative embodiment of Embodiment 3 of an operation vehicle of the present application.
Figure 11:
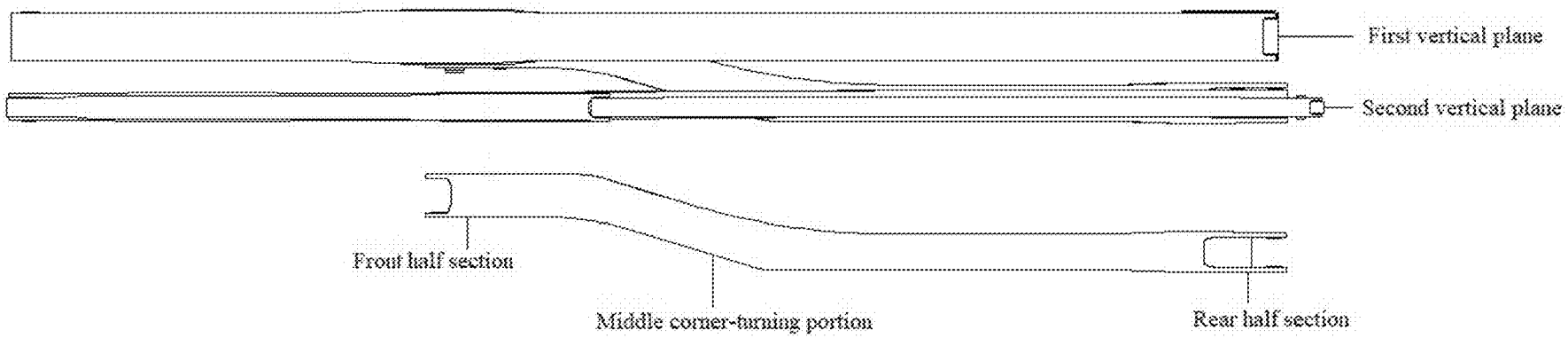
FIG. 11 shows a "corner-turning boom" that transitions from within the "first vertical plane" to within the "second vertical plane."

In an alternative embodiment, as shown in FIG. 9 and FIG. 10, when the boom device is in the folded state, the second boom 2 is located above the first boom 1, the third boom 3 includes a front half section, a rear half section and a middle corner-turning portion for avoiding the rotary table, the front half section of the third boom 3 is located below the second boom 2, the fourth boom 4 is located above the rear half section of the third boom 3, the first boom 1, the second boom 2 and the front half section of the third boom 3 are folded in the first vertical plane, the rear half section of the third boom 3 and the fourth boom 4 are folded in a second vertical plane, the third boom 3 is a corner-turning boom, and the middle corner-turning portion of the third boom 3 transitions from within the first vertical plane to within the second vertical plane.

Except for different setting position of the rotary table 200 and different folding manners of each of the above booms, the pump vehicle structure in Embodiment 3 is the same as the pump vehicle structure in Embodiment 1 and Embodiment 2, and will not be repeated redundantly herein.

Embodiment 4

Figure 8:
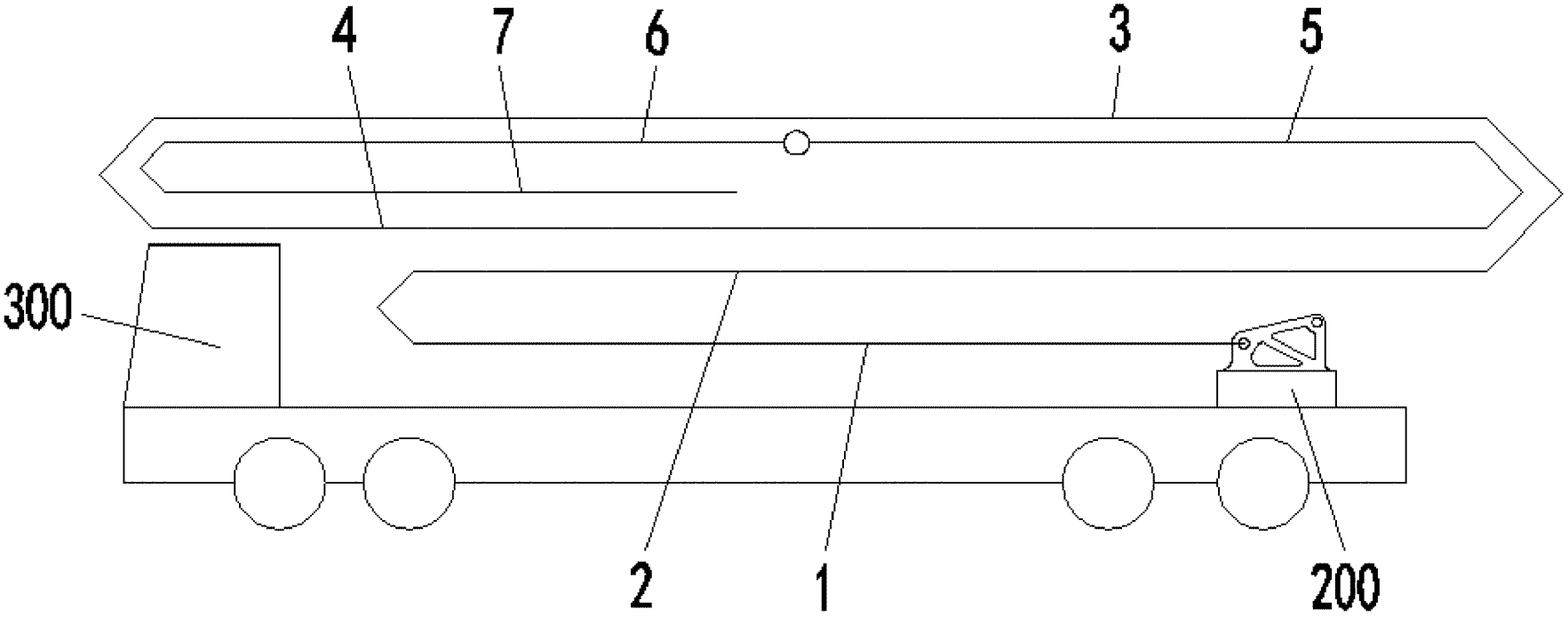
FIG. 8 shows a structural schematic diagram of a boom device of Embodiment 4 of an operation vehicle of the present application.

As shown in FIG. 8, the pump vehicle in Embodiment 4 differs from the pump vehicle in Embodiment 1 to Embodiment 3 as follows: the rotary table 200 is arranged at a rear part of the vehicle body, therefore, the pump vehicle in Embodiment 4 is a pump vehicle arranged behind the rotary table 200. The head end of the fourth boom 1 is connected with the rotary table 200, and end portions of the third boom 3, the fourth boom 4, the sixth boom 6 and the seventh boom 7 are all located above the cab 300. In embodiment 4, since end portions of four booms are located above the cab 300, more booms can be designed to be longer, thereby further improving construction flexibility.

Moreover, in technical solutions of Embodiment 4, the first boom 1, the second boom 2, the third boom 3 and the fourth boom 4 are folded in an inverted RZ-type manner. Specifically speaking, the first boom 1, the second boom 2, the third boom 3 and the fourth boom 4 are first folded in a Z-type manner, and then are folded in an R-type manner, thereby calling an inverted RZ-type folding.

Specifically speaking, positional relationships and folding manners of the first boom 1, the second boom 2, the third boom 3 and the fourth boom 4 in Embodiment 4 are specifically as follows: the first boom 1 extends along a horizontal direction, and the second boom 2 is folded upwards clockwise relative to the first boom 1. The third boom 3 is folded upwards anticlockwise relative to the second boom 2, moreover, the tail end of the third boom 3 extends above the cab 300. Since the folding directions of the third boom 3 and the second boom 2 are opposite to the folding directions of the second boom 2 and the first boom 1, therefore, the first boom 1, the second boom 2 and the third boom 3 are all folded in a Z-type manner. The fourth boom 4 is folded downwards anticlockwise relative to the third boom 3, moreover, the fourth boom 4 is arranged below the third boom 3. Since the tail end of the third boom 3 is located above the cab 300, therefore, the head end of the fourth boom 4 is also located above the cab. Since the folding directions of the fourth boom 4 and the third boom 3 are anticlockwise relative to the folding directions of the third boom 3 and the second boom 2, therefore, the second boom 2, the third boom 3 and the fourth boom 4 are all folded in an R-type manner. The tail end of the fourth boom 4 is connected with the fifth boom 5, the sixth boom 6 and the seventh boom 7, and the fifth boom 5, the sixth boom 6 and the seventh boom 7 are all located above the fourth boom 4. Particularly, in Embodiment 4, the tail end of the sixth boom 6 extends above the cab 300, therefore, the head end of the seventh boom 7 is also located above the cab 300.

Further, the first boom 1, the second boom 2 and the head end of the third boom 3 are folded in the first vertical plane, the tail end of the third boom 3, the fourth boom 4 and the fifth boom 5 are folded in a second vertical plane, the third boom 3 is a corner-turning boom, and the third boom 3 transitions from within the first vertical plane to within the second vertical plane.

In embodiment 4, since the tail end of the third boom 3, the head end of the fourth boom 4, the tail end of the sixth boom 6 and the head end of the seventh boom 7 are all located above the cab 300, therefore, the above four booms can utilize the space above the cab and can be designed to be longer, thereby further improving construction flexibility.

The pump truck in Embodiment 4 has the same structures as Embodiments 1 to 3, except for different setting position of the rotary table 200, the folding manners of each boom, and the number of booms located above the cab 300, and other structures of the pump vehicle are not repeated redundantly herein.

Apparently, the above embodiments are merely for clearly illustrating examples, rather than limiting the embodiments. For those skilled in the art, other variations or alterations in different forms may be made on the basis of the above description. All the embodiments do not need to be and also cannot be enumerated herein, while apparent variations or alterations arising therefrom still fall within the protection scope of the present application.

The invention claimed is:

1. An operation vehicle, comprising a vehicle body and a cab provided at a front end of the vehicle body, and further comprising a boom device provided on the vehicle body, wherein the boom device comprises at least seven booms hinged end to end in sequence, and when the boom device is in a folded state, a fifth boom and a sixth boom are located on the same straight line, a seventh boom is located below the sixth boom, and end portions of at least two booms in the seven booms are located above the cab wherein the operation vehicle further comprises a vehicle body and a rotary table arranged on the vehicle body, the rotary table is arranged on a rear part of the vehicle body, a head end of a first boom is connected with the rotary table, and end portions of a third boom, a fourth boom, the sixth boom and the fifth boom are all located above the cab, wherein, when the boom device is in a folded state, a second boom is located above the first boom, the third boom is located above the second boom, a head end of the fourth boom is located below the third boom, the fifth boom and the sixth boom are both located above the fourth boom, and the seventh boom is located below the sixth boom, wherein the first boom, the second boom, the third boom and the head end of the fourth boom are folded in a first vertical plane, a tail end of the fourth boom and the fifth boom are folded in a second vertical plane, the fourth boom is a corner-turning boom in that the fourth boom transitions from within the first vertical plane to within the second vertical plane.

* * * * *